US008870333B2

(12) United States Patent
Yasutani et al.

(10) Patent No.: US 8,870,333 B2
(45) Date of Patent: Oct. 28, 2014

(54) PRINTING APPARATUS CONTROL METHOD FOR PRINTING APPARATUS

(71) Applicant: Canon Kabushiki Kaisha, Tokyo (JP)

(72) Inventors: Jun Yasutani, Yokohama (JP); Hiroshi Tajika, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 64 days.

(21) Appl. No.: 13/718,521

(22) Filed: Dec. 18, 2012

(65) Prior Publication Data

US 2013/0176357 A1 Jul. 11, 2013

(30) Foreign Application Priority Data

Jan. 10, 2012 (JP) ..... 2012-002309
Nov. 2, 2012 (JP) ..... 2012-242729

(51) Int. Cl.

*B41J 29/38* (2006.01)
*B41J 29/393* (2006.01)
*B41J 2/045* (2006.01)
*B41J 2/14* (2006.01)

(52) U.S. Cl.

CPC ..... *B41J 2/0454* (2013.01); *B41J 2/14072* (2013.01); *B41J 2/04598* (2013.01); *B41J 2/14153* (2013.01); *B41J 2/04563* (2013.01); *B41J 2/0458* (2013.01); *B41J 2/04588* (2013.01); *B41J 2/04543* (2013.01)

USPC ..... 347/17; 347/14; 347/19

(58) Field of Classification Search

CPC .. B41J 2/0458; B41J 2/04563; B41J 2/14153; B41J 2/14072; B41J 2202/13

USPC ..... 347/14, 17, 19

See application file for complete search history.

(56) References Cited

U.S. PATENT DOCUMENTS

| | | | | |
|---|---|---|---|---|
| 5,880,751 | A | 3/1999 | Nishikori et al. | |
| 6,412,934 | B1 | 7/2002 | Moriyama et al. | |
| 6,457,794 | B1 | 10/2002 | Tajika et al. | |
| 6,644,770 | B1 | 11/2003 | Niimura et al. | |
| 6,729,709 | B2 | 5/2004 | Konno et al. | |
| 6,827,413 | B1 | 12/2004 | Kawatoko et al. | |
| 6,957,880 | B2 | 10/2005 | Kawatoko et al. | |
| 6,960,036 | B1 | 11/2005 | Fujita et al. | |
| 7,404,612 | B2 | 7/2008 | Takamiya et al. | |
| 2002/0149657 | A1 * | 10/2002 | Ishinaga et al. | 347/100 |

FOREIGN PATENT DOCUMENTS

| | | | |
|---|---|---|---|
| JP | 2000-085128 | A | 3/2000 |
| JP | 2002-264305 | A | 9/2002 |

* cited by examiner

*Primary Examiner* — Jannelle M Lebron

(74) *Attorney, Agent, or Firm* — Fitzpatrick, Cella, Harper & Scinto

(57) ABSTRACT

A printing apparatus and temperature detecting method can accurately obtain temperature of a printing element substrate and output a high-quality image at high resolution and high speed. For this purpose, a first temperature sensor outputting signals through a first output line and a second temperature sensor outputting signals through a second output line that is longer than the first output line are provided on the printing element substrate. In addition, a switch between the case of using detected temperatures obtained from both of the first temperature sensor and the second temperature sensor to calculate the temperature of the printing element substrate, and the case of using only the detected temperature obtained from the first temperature sensor to calculate the temperature of a printing element substrate is made. On this basis, inaccurate temperature of a printing element substrate due to noise can be avoided.

15 Claims, 17 Drawing Sheets

PRINTING APPARATUS CONTROL METHOD FOR PRINTING APPARATUS

BACKGROUND OF THE INVENTION

1. Field of the Invention

The present invention relates to an inkjet printing apparatus. In particular, the present invention relates to an inkjet printing apparatus that, with use of an inkjet print head provided with a printing element substrate on which electrothermal transducing elements are arrayed, prints an image while detecting temperature of the printing element substrate.

2. Description of the Related Art

An inkjet print head provided with electrothermal transducing elements can eject small droplets of ink at a high frequency, and a printing apparatus using such a print head can output an image at high sped and high resolution. In the inkjet print head provided with the electrothermal transducing elements, a voltage pulse is applied to each of the electrothermal transducing elements (heaters) according to an ejection signal to make the electrothermal transducing element generate heat. The inkjet print head is configured such that by generating the heat, film boiling occurs in the ink in contact with the electrothermal transducing element, and by growth energy of a generated air bubble, the ink is ejected from an ejection port as a droplet.

In such an inkjet print head, temperature of a printing element substrate on which the plurality of electrothermal transducing elements are arrayed is changed depending on a drive frequency, i.e., an ejection frequency of each of the electrothermal transducing elements. Also, a size of a bubble in the electrothermal transducing element, i.e., an amount of the ink ejected from a corresponding ejection port (ejection amount) depends on the temperature of the printing element substrate. On the other hand, the ejection amount from the electrothermal transducing element is also changed depending on a pulse shape of a voltage pulse applied to the electrothermal transducing element. From the above, many of inkjet print heads each provided with electrothermal transducing elements are adapted to adjust a pulse shape applied to each of the electrothermal transducing elements according to detected temperature of a printing element substrate, and keep a stable ejection amount independently of the temperature of the printing element substrate.

For example, Japanese Patent Laid-Open No. 2000-85128 discloses a method for estimating temperature of the whole of one printing element substrate on the basis of an output result from a plurality of temperature sensors provided on the printing element substrate. An output value from a temperature sensor is largely influenced by a drive frequency of an electrothermal transducing element positioned near the temperature sensor, and therefore it is difficult to obtain average temperature of the whole of a printing element substrate from a detection result of one temperature sensor. As disclosed in Japanese Patent Laid-Open No. 2000-85128, depending on not only detected temperatures of the plurality of temperature sensors but positions of the temperature sensors, a drive frequency within a predetermined period of time, and a driven electrothermal transducing element density, corrections of the detected temperatures of the temperature sensors are made, and thereby more accurate temperature of the printing element substrate can be obtained.

Meanwhile, in a serial type inkjet printing apparatus in which a length of one print scan is long, a rise in temperature of a printing element substrate during the scan is large, and during the one scan, ejection amount control as described above is required. In this case, control including detecting the temperature of the printing element substrate and feeding back the detected temperature to each electrothermal transducing element has to be performed during one scan of a print head.

Also, a printing element substrate used for an inkjet print head is electrically connected to the outside through a flexible wiring board. For this reason, on the flexible wiring board, driving voltage wiring for applying driving voltage to each of an electrothermal transducing elements on the printing element substrate, logic wiring for sending a driving signal, wiring for providing an output from a temperature sensor are mutually adjacently provided.

During a scan of the inkjet print head, each of the electrothermal transducing elements on the printing element substrate is energized by on/off of the driving signal, and current flows through the driving voltage wiring provided on the flexible wiring board. If large current flows through the driving voltage wiring, electromagnetic inductive noise is superimposed on an adjacent temperature sensor output signal line on the flexible wiring board. As a result, the noise is superimposed on an analog signal resulting from temperature detection to prevent accurate temperature detection, and therefore ejection control becomes unstable, which causes an adverse effect such as density unevenness on an image.

In order to solve such a problem, for example, Japanese Patent Laid-Open No. 2002-264305 discloses a method that monitors a temperature sensor provided on a printing element substrate at a time when a driving signal to an electrothermal transducing element is in a disabled (off) state. According to the method disclosed in Japanese Patent Laid-Open No. 2002-264305, when an analog signal serving as temperature information is transmitted, the driving signal is not transmitted, so that no interference occurs between them, and noise is also not added to the analog signal.

However, as in recent years when further increases in speed and resolution are required, even in the case of using the method disclosed in Japanese Patent Laid-Open No. 2002-264305, it is difficult to effectively obtain temperature of a printing element board. For example, in a situation where the increase in speed and improvement in image quality are required, printing is performed at high-resolution ejection timing, and therefore it is difficult to ensure a time when all of driving signals applied to electrothermal transducing elements on a printing element substrate come into the disables (OFF) state. In particular, in the case of performing ejection at high density, a temperature rise of the printing element substrate is drastic, and more frequent monitoring of a temperature sensor is required; however, nevertheless, the time when a driving pulse is disabled (turned OFF) is further limited.

Also, as disclosed in Japanese Patent Laid-Open No. 2000-85128, in the case where a plurality of temperature sensors are provided on one printing element substrate, a wiring length from each of the temperature sensors to a part that is provided on the printing element substrate and connected to a printing apparatus main body is different for each of the temperature sensors. That is, an amount of noise superimposed in a wiring path to the connecting part is different for each of the temperature sensors, and information on a temperature sensor having a longer wiring length becomes less accurate than that of a temperature sensor having a shorter wiring length. Also, an appropriate temperature correction process for removing the noise is required for each of the temperature sensors, and therefore much more processing time is required to obtain temperature.

As described, in the situation where the increases in speed and resolution, it is still difficult to highly accurately obtain temperature of a printing element substrate during a print scan, and on the basis of the obtained temperature, perform appropriate ejection amount control.

SUMMARY OF THE INVENTION

The present invention is made in order to solve the above-described problem. Therefore, an object of the present invention is to provide a printing apparatus that can accurately obtain temperature of a printing element substrate, and output a high-quality image at high resolution and high speed.

In a first aspect of the present invention, there is provided a printing apparatus comprising: a printing element substrate having a plurality of printing elements which generate heat energy by being applied with a driving pulse, a first temperature sensor and a second temperature sensor; a contact board contacting the printing element substrate, that is provided with a driving line for applying energy to the plurality of printing elements to drive them, a first output line for outputting signal from the first temperature sensor and a second output line being longer than the first output line and outputting signal from the second temperature sensor; and temperature calculating unit which calculates a temperature of the printing element substrate by using signals transmitted through the contact board from the first temperature sensor and the second temperature sensor, wherein the temperature calculating unit switches between one case for calculating the temperature of the printing element substrate by using both of detected temperatures from the first temperature sensor and the second temperature sensor, and the other case for calculating the temperature of the printing element substrate by using only detected temperature from the first temperature sensor.

In a second aspect of the present invention, there is provided a control method for a printing apparatus: the apparatus including: a printing element substrate having a plurality of printing elements which generate heat energy by being applied with a driving pulse, a first temperature sensor and a second temperature sensor; and a contact board contacting the printing element substrate, that is provided with a driving line for applying energy to the plurality of printing elements to drive them, a first output line outputting signal from the first temperature sensor and a second output line being longer than the first output line and outputting signal from the second temperature sensor; said control method comprising steps of: obtaining detected temperatures from the first temperature sensor and the second temperature sensor; and temperature calculating step which switches between a first calculating control wherein the temperature of the printing element substrate is calculated by using both of detected temperatures from the first temperature sensor and the second temperature sensor, and a second calculating control wherein the temperature of the printing element substrate is calculated by using only the detected temperature from the first temperature sensor.

Further features of the present invention will become apparent from the following description of an exemplary embodiment with reference to the attached drawings.

DESCRIPTION OF THE EMBODIMENTS (First Embodiment)

Figure 1:
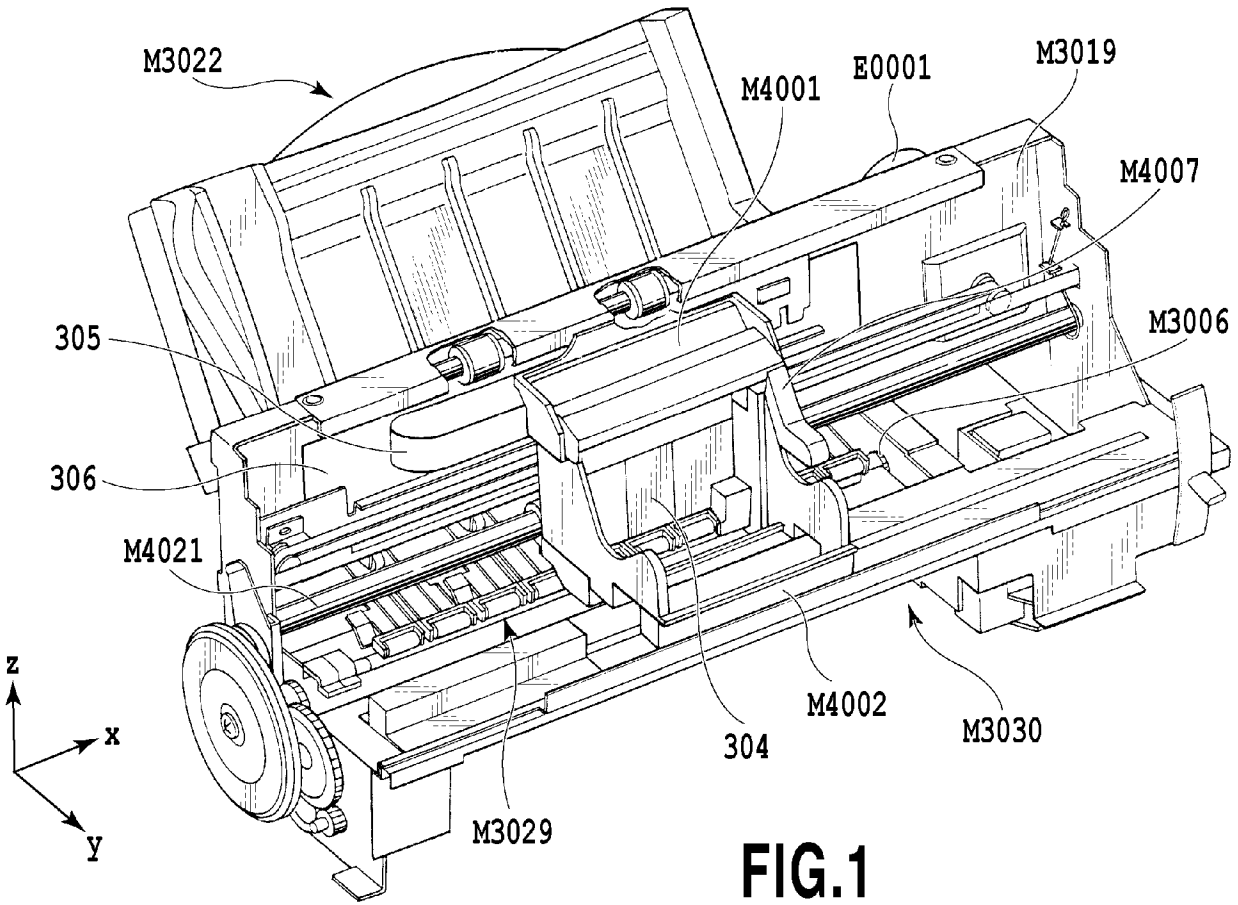
FIG. 1 is a perspective view for explaining an internal configuration of a printing apparatus.

FIG. 1 is a perspective view for explaining an internal configuration of an inkjet printing apparatus used in the present embodiment. A print head H (not illustrated in FIG. 1) attachable/detachable to/from a carriage M4001 is attached into the carriage M4001 by a head set lever M4007 with engaging with a carriage cover M4002. The carriage M4001 can reciprocate in an X direction in the view with use of a carriage motor E0001 as a driving source while being guided and supported by a carriage shaft M4021, and during the reciprocation of the carriage M4001, the print head H ejects ink according to a driving signal. Print data and temperature information on a printing element substrate, which are necessary for the print head H to perform the ejection, are transceived through a cable 305 and a carriage board 304 fixed to the carriage M4001. The cable 305 is a cable that, while following the reciprocation of the carriage M4001, makes an electrical connection between the carriage M4001 and a main board 306 fixed to a chassis M3019.

Print media (not illustrated) loaded on a paper feed tray M3022 are fed into the apparatus, and then conveyed in a Y direction in the view with being held between a roller pair of a conveying roller M3006 and a pinch roller M3029 along with rotation of them. By alternately repeating a print scan in the X direction by the print head H mounted on the carriage M4001, and a print medium conveying operation corresponding to a print width of the print head H, a print medium is printed with an image in a stepwise manner and then discharged from a discharge port M3030.

Figure 2:
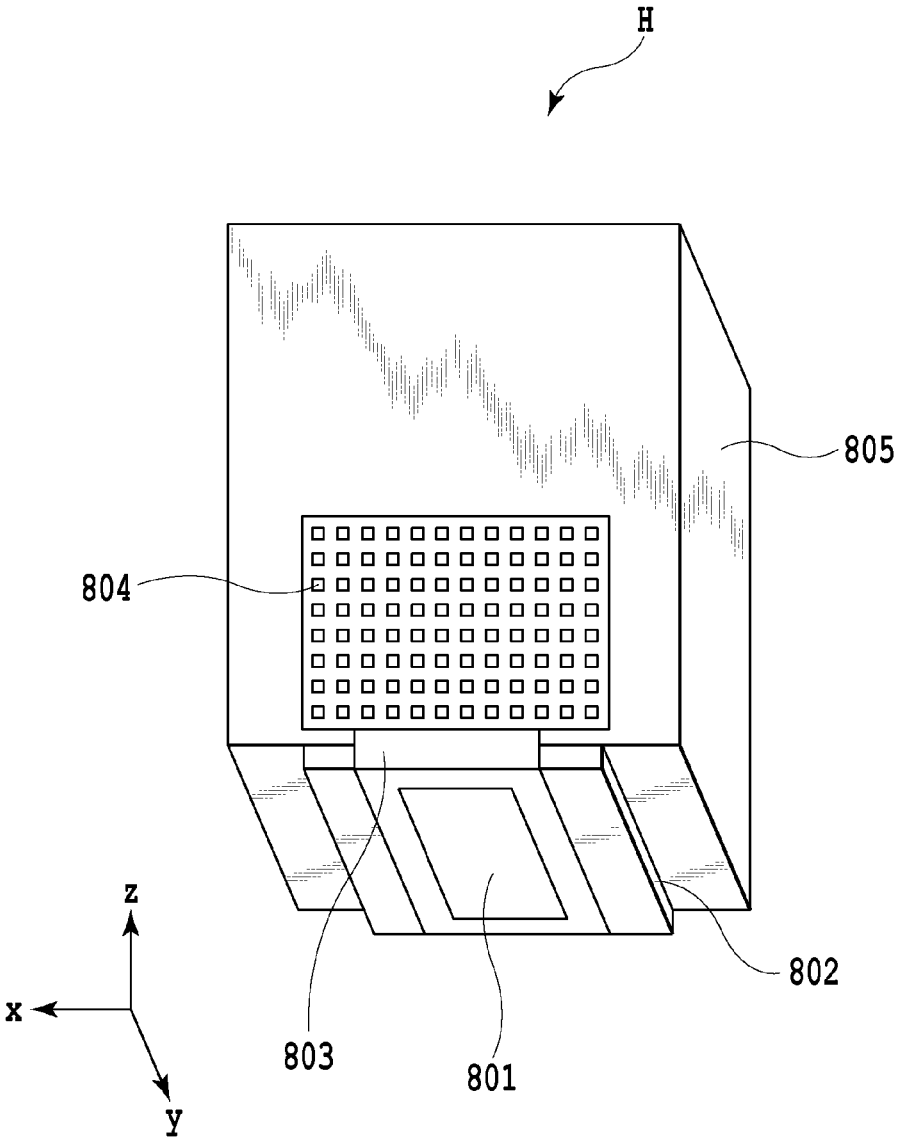
FIG. 2 is an appearance perspective view of a print head H.

FIG. 2 is an appearance perspective view of the print head H. A printing element substrate 801 on which a plurality of printing elements are formed is formed on a support board 802, and along with application of a driving pulse, ejects ink supplied form an ink supply unit 805 in a −Z direction as a droplet. In the printing element substrate 801, the driving pulse is applied to a plurality of electrothermal transducing elements (heaters) that are prepared with being related to the respective printing elements. A driving signal for generating the driving pulse is inputted to the printing element substrate 801 through a contact terminal wiring board 804, a flexible wiring board 803, and the like. The contact terminal wiring board 804 is configured to be electrically connected to the carriage board 304 when the print head H is attached to the carriage M4001.

The printing element substrate is described in detail. The printing element substrate 801 is configured such that on one surface of a Si substrate, the plurality of electrothermal transducing elements (heaters) and wiring lines made of Al or the like for supplying power to the respective electrothermal transducing elements are formed by a deposition technique. Further, a plurality of ejection ports respectively related to the electrothermal transducing elements, and ink paths respectively for guiding the ink to the electrothermal transducing elements and ejection ports are formed by a photolithography technique.

The support board 802 is made of a material such as aluminum, aluminum alloy, or ceramics, and supports the printing element substrate 801 as well as playing a role as a heat radiation member for efficiently radiating heat generated by heating. The support board 802 is formed with: an ink supply port for receiving the ink from the ink supply unit 805; and a common liquid chamber for guiding the ink to the plurality of ink paths in common. The common liquid chamber is formed so as to be opened on a surface bonded to the printing element substrate 801, and the ink supply port is formed so as to be opened on a surface on a side opposite to the bonding surface of the support board 801. The present embodiment is configured such that when the printing element substrate 801 is bonded to the bonding surface of the support board 802, an ink liquid chamber of the printing element substrate 801 and the common liquid chamber of the support board 802 are communicatively connected to each other.

The flexible wiring board 803 is bonded and retained with being electrically connected to the printing element substrate 801. The flexible wiring board 803 and the contact terminal wiring board 804 are connected to each other by means of ACF, lead bonding, wire bonding, patterning, connector, or the like.

Note that, in the present embodiment, it is assumed that, on the printing element substrate 801, four printing element arrays 700 each in which 1024 printing elements are arrayed in the Y direction are parallel arranged in the X direction.

Figure 3:
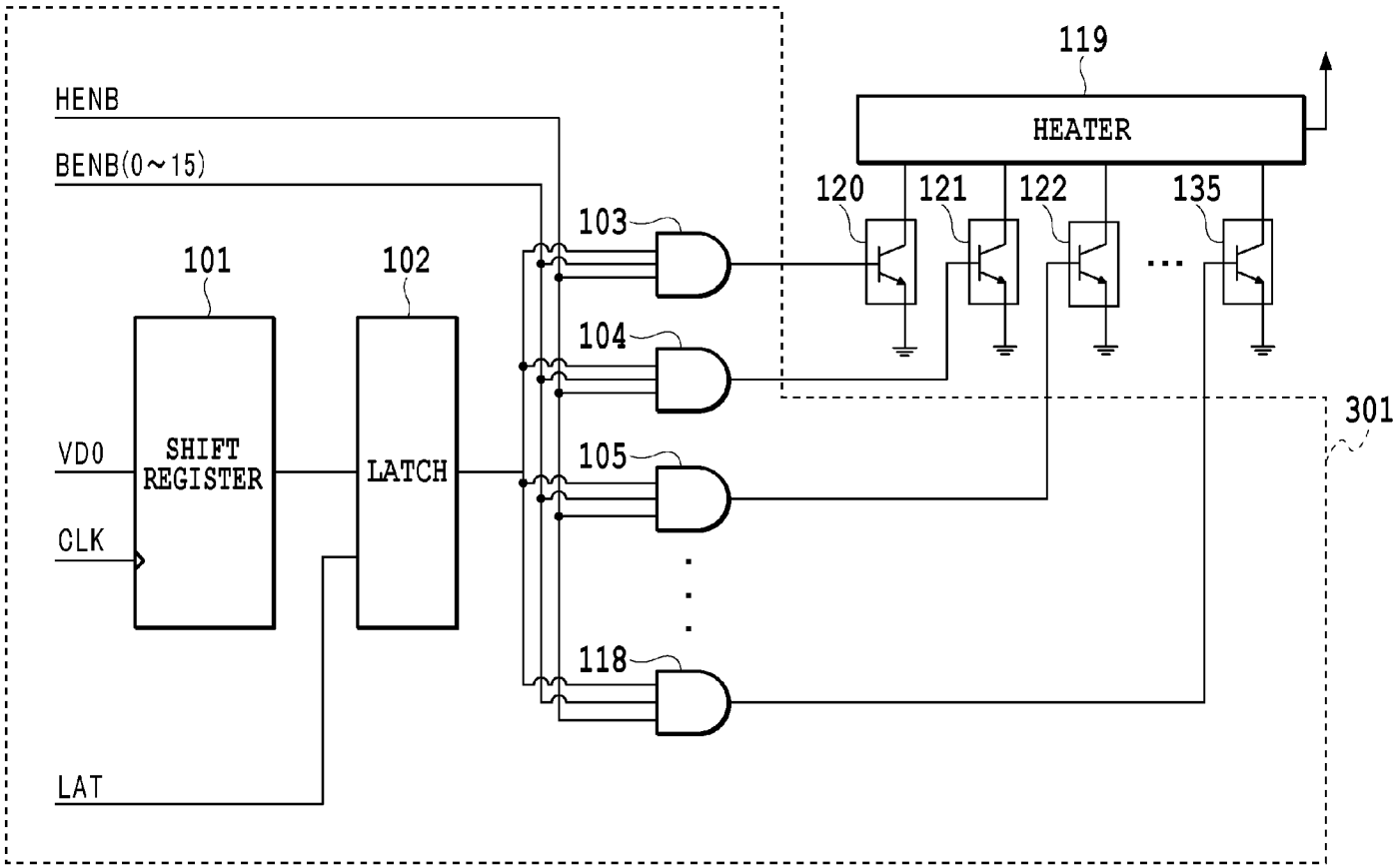
FIG. 3 is a driving circuit diagram of a printing element substrate.

FIG. 3 is a driving circuit diagram for performing driving control of the electrothermal transducing elements in one of the printing element arrays on the printing element substrate 801. A heater 119 equipped on the printing element substrate 801 is electrically divided to demarcate 1024 electrothermal transducing elements. The 1024 electrothermal transducing elements are grouped into 16 blocks, and the respective blocks are related to transistors 120 to 135 and AND circuits 103 to 118.

Binary image data (VDO) is inputted to a shift register 101 on a pixel basis in synchronization with a transfer clock (CLK), and then subjected to a serial-parallel conversion. Then, when 1024 bits of image data, which correspond to the number of the printing elements, are accumulated, the pieces of accumulated data are converted into a latch signal, which is then latched by a latch circuit 102.

A heater driving signal (HENB) is equally inputted to the AND circuits 103 to 118 respectively prepared for the blocks; however, a block signal (BENB0 to 15) is inputted to the AND circuit 103 to 118 at a time that is different among the blocks. As described, the pieces of image data (VDO), heater driving signal (HENB), and block signals (BENB0 to 15) are inputted to the AND circuits 103 to 118, and thereby the respective printing elements eject the ink according to the pieces of image data at times of the heater driving signal for corresponding blocks. In the present embodiment, driving circuits as described above are prepared respectively for the (four) printing element arrays. A pulse shape of the heater driving signal (HENB) is changed depending on detected temperature of the printing element substrate 804.

Figure 4:
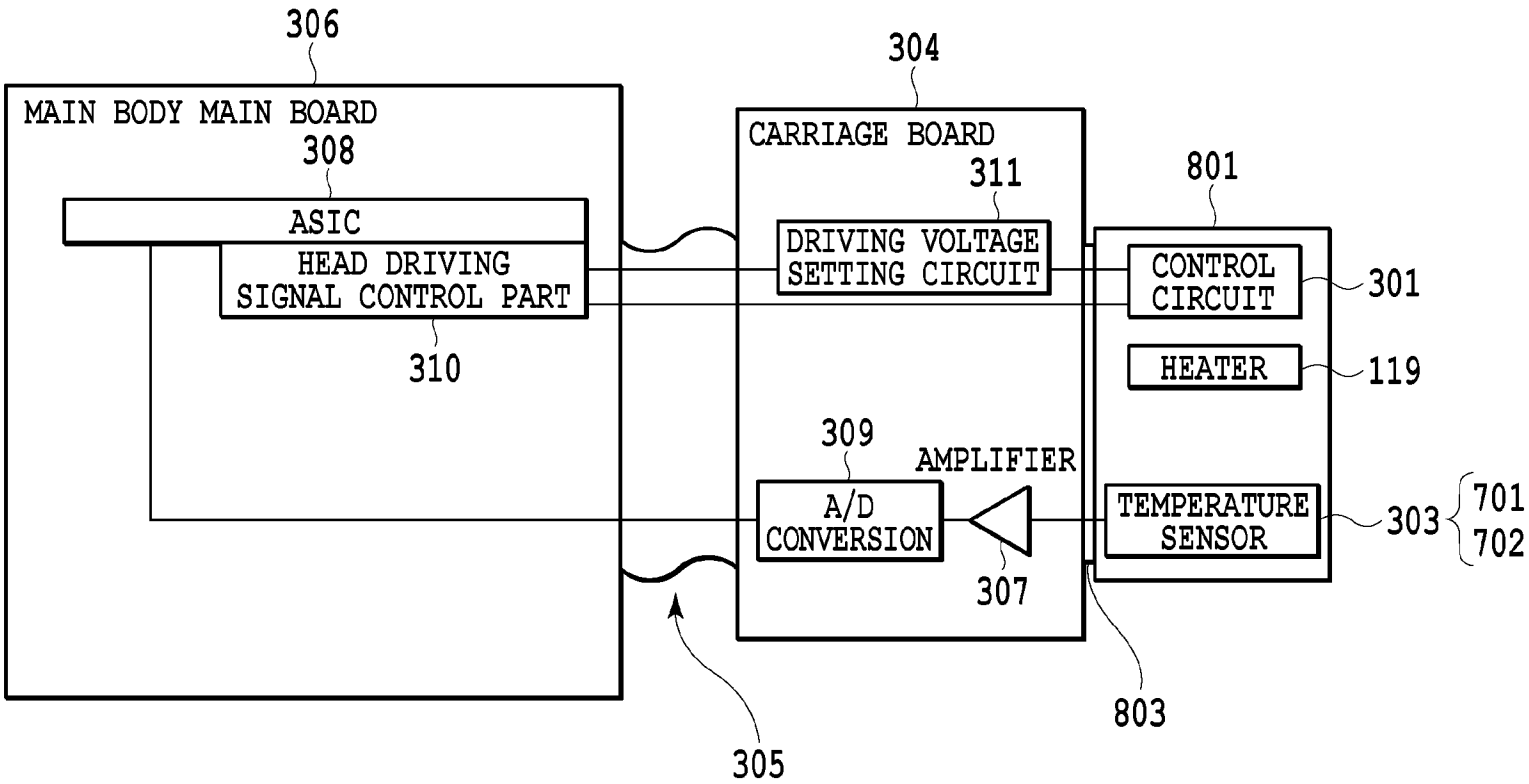
FIG. 4 is a diagram illustrating a transmission path and circuit configuration between a main board and the printing element substrate.

FIG. 4 is a diagram illustrating a transmission path of the driving signal from the main board 306 to the printing element substrate 801, and a circuit configuration. A parameter signal generated in the main board 306 of the printing apparatus main body is inputted to the carriage board 304 through the cable 305. Then, the parameter signal is transmitted to the printing element substrate 801 through the contact terminal wiring board 804, the flexible wiring board 803, and the like.

On the printing element substrate 801, in addition to a control circuit 301 illustrated in FIG. 3, a plurality of temperature sensors 303 for measuring temperature of the printing element substrate 801 is equipped. Analog data detected by each of the temperature sensors 303 is inputted to the carriage board 304 through the flexible wiring board 803 and the contact wiring board 804. In the carriage board 304, the analog data is subjected to an amplification process by an amplifier 307; then converted to digital data by an A/D converter 309; and subsequently transmitted to the main board 306 through the cable 305.

An ASIC 308 taking charge of control of the whole of the printing apparatus estimates the temperature of the printing element substrate 802 on the basis of a plurality of pieces of temperature data having been subjected to the digital conversion, and instructs a head driving signal control part 310 to adjust the driving pulse into an appropriate shape. The head driving signal control part 310 sets a pulse parameter corresponding to the pieces of obtained temperature data, and transmits the parameter to the carriage board 304 through the cable 305. A driving voltage setting circuit 311 that is arranged on the carriage board 304 and includes a D/A converter generates the heater driving signal (HENB) according to the parameter received from the head driving signal control part 310, and transmits it to the control circuit 301. In addition, the header driving signal (HENB) may be adjusted by providing a DC/DC converter in the control circuit 301.

In the past, the amplifier 307 and the A/D converter 309 have been often provided on the main board 306; however, in such a case, data is transmitted in an analog signal state along a long wiring path from the control circuit 301 to the main board 306 to cause a large influence of noise. As in the present embodiment, by providing the amplifier 307 and the A/D converter 309 on the carriage board 304, lengths of wiring lines through which the pieces of data are transmitted in an analog data state from the temperature sensors 303 can be shortened to reduce the influence of noise. However, the present embodiment is not limited to such a configuration. The present embodiment may be configured such that the main board 306 is equipped with both of the amplifier 307 and the A/D converter 309, or only the A/D converter 309.

Figure 5:
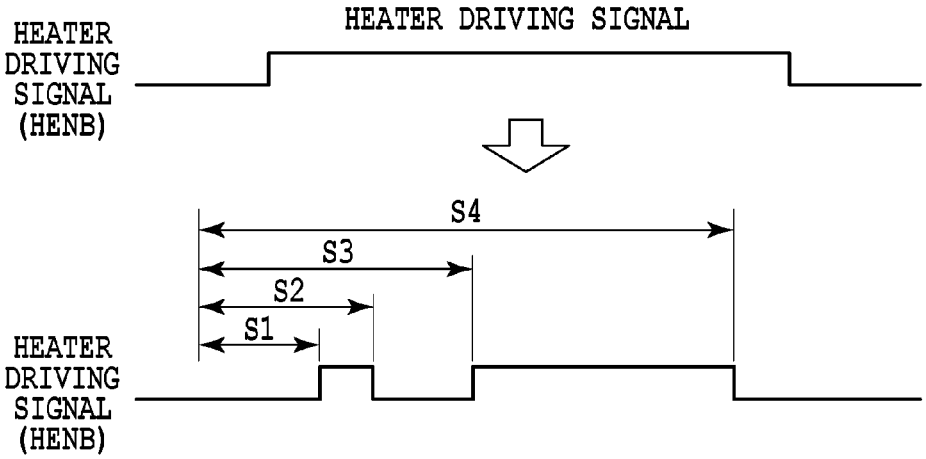
FIG. 5 is a diagram illustrating an example of a heater driving signal (HENB) corresponding to a single ejection operation.

FIG. 5 is a diagram illustrating an example of the heater driving signal (HENB) corresponding to a single ejection operation. The horizontal axis represents time, and the vertical axis represents voltage. The upper part represents an example of a single pulse, and the lower part represents an example of a double pulse. In the case of the single pulse, by changing a width or voltage of the pulse, an ejection amount can be modulated. For example, in the case where the detected temperature of the printing element substrate is high, the ejection amount tends to be larger than a standard amount. Accordingly, in this case, a driving pulse having a higher driving voltage and smaller pulse width than standard values is applied, and thereby a time for heat to transmit from each of the electrothermal transducing elements to the ink is kept short to decrease the ejection amount. On the other hand, in the case where the detected temperature of the printing element substrate is low, the ejection amount tends to be smaller than the standard amount. Accordingly, in this case, a driving pulse having a lower driving voltage and larger pulse width than the standard values is applied, and thereby the time for heat to transmit from each of the electrothermal transducing elements to the ink is increased to increase the ejection amount.

On the other hand, in the case of the double pulse, by changing a width of a pre-pulse (S2–S1) preliminarily applied before a main pulse (S4–S3) contributing to the actual ejection, or a width of an interval (S3–S2), the ejection amount can be modulated. For example, in the case where the detected temperature of the printing element substrate is high, by decreasing the width of the pre-pulse (S2–S1) and increasing the width of the interval (S3–S2), a temperature rise of the ink in contact with each of the electrothermal transducing elements can be suppressed to decrease the ejection amount. On the other hand, in the case where the detected temperature of the printing element substrate is low, by increasing the width of the pre-pulse (S2–S1) and decreasing the width of the interval (S3–S2), the temperature rise of the ink in contact with each of the electrothermal transducing elements can be increased to increase the ejection amount.

Figure 6:
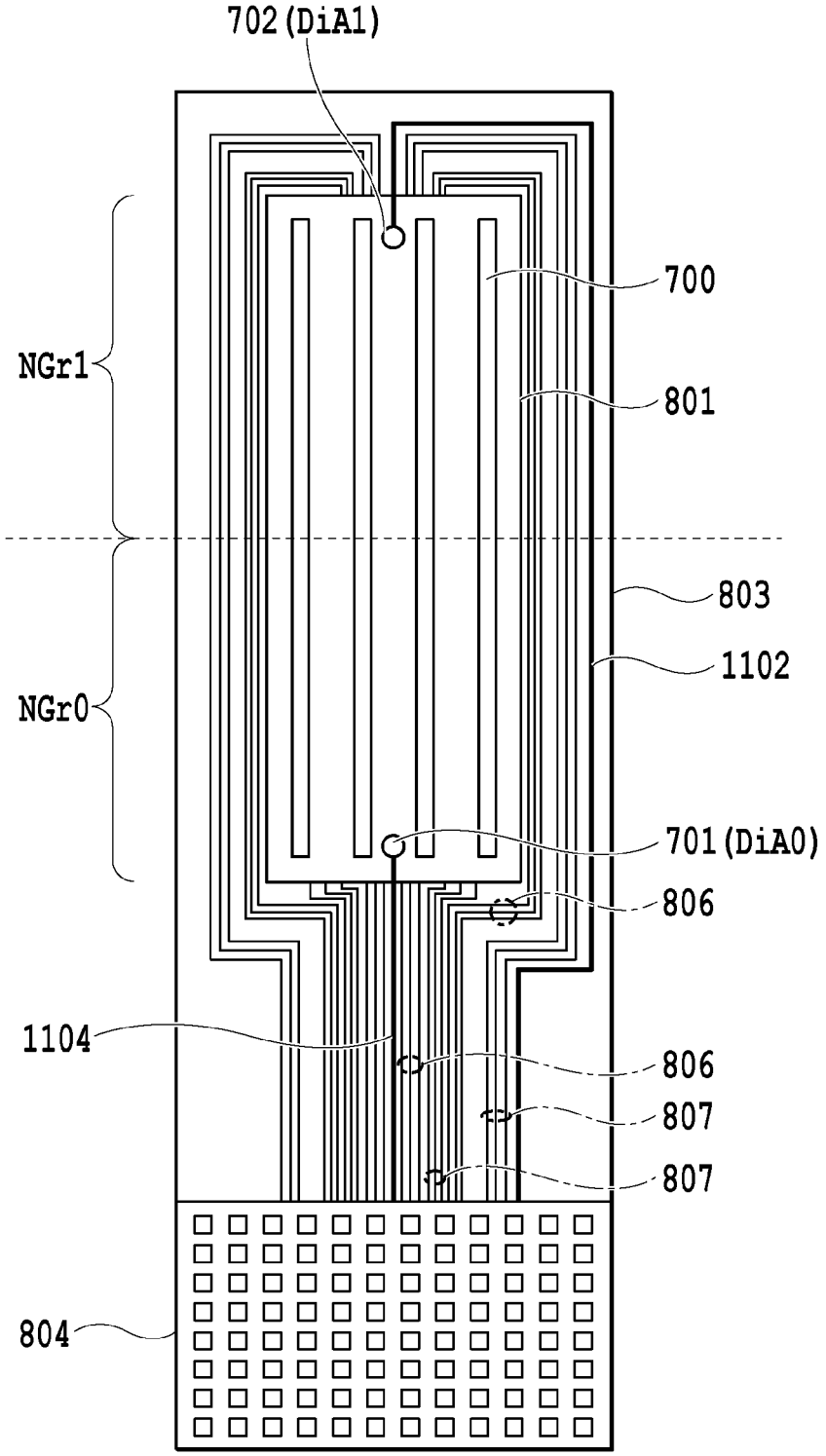
FIG. 6 is a diagram in which the printing element substrate is observed from an ejection port face.

FIG. 6 is a diagram in which the printing element substrate 801 and the flexible wiring board 803 are observed from an ejection port face. On the printing element substrate 801 of the present embodiment, the four printing element arrays 700 each in which the 1024 printing elements are arrayed in the Y direction at pitches of 1200 dpi are parallel arranged in the X direction. Further, the flexible wiring board 803 is formed so as to surround the printing element substrate 801 provided with the four printing element arrays.

The printing element substrates 801 of the present embodiment is equipped with two temperature sensors 701 and 702, and on the basis of detected values of the two temperature sensors, the temperature of the whole of the printing element substrate 801 is estimated. The temperature sensors 701 is arranged on a side closer to the contact wiring board 804 with respect to the printing element arrays 700 and the temperature sensors 702 is arranged on a side opposite to the contact wiring board 804 respectively. Accordingly, a wiring line 1104 that makes a connection between the temperature sensor 701 and the contact wiring board 804 is relatively short, whereas a wiring line 1102 that makes a connection between the temperature sensor 702 and the contact wiring board 803 is arranged so as to surround an area of the control circuit 301, and therefore approximately 10 times longer than the wiring line 1104. In addition, in the present embodiment, each of the temperature sensors 701 and 702 is a diode sensor (DiA0, DiA0), and uses a characteristic in which forward voltage changes depending on temperature. However, a temperature detecting device other than a diode can also be utilized.

Wiring of such a flexible wiring board 803 has minute structure. Also, logic signal lines 806 for driving the electrothermal transducing elements, wiring lines 807 for applying driving voltage (Vh), wiring lines 807 for applying ground for the driving voltage (Vh_GND), and the wiring lines 1102 and 1104 connected to the diode sensors are arranged. In such wiring lines 807 for applying the driving voltage, currents flow by driving of the electrothermal transducing elements. When the currents flow in such wiring lines 807, the wiring lines 1102 and 1104 are likely to be interfered with a the currents flowing into and out of these signal lines. Also, the magnitude of electromagnetic inductive noise to be superimposed is increased in proportion to a length of each of the wiring lines 1102 and 1104 arranged in parallel with each of the wiring lines 807 and 806, and an amount of current flowing into each of the wiring lines 807 and 806. Accordingly, in the case of the wiring illustrated in FIG. 6, a detected signal of the temperature sensor 702, which is received through the wiring line 1102, has larger noise and lower detection accuracy than those of a detected signal of the temperature sensor 701, which is received through the wiring line 1104.

Figure 7A:
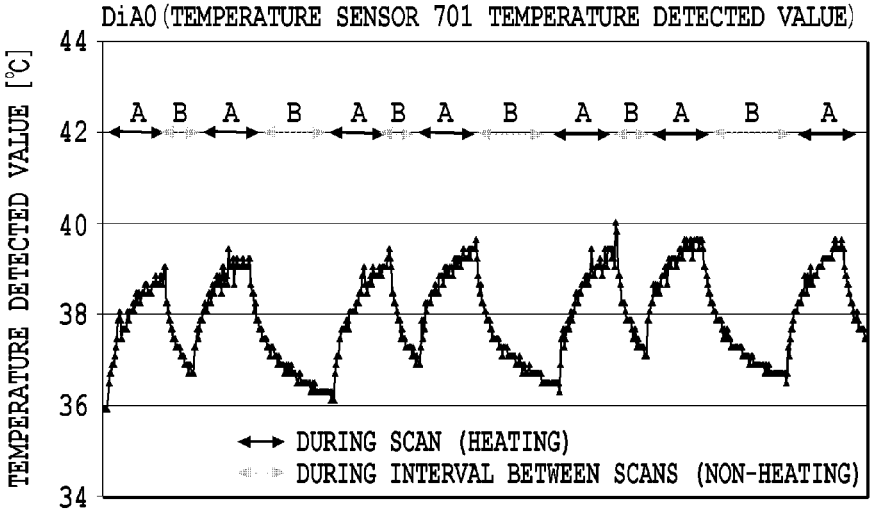
FIGS. 7A and 7B are diagrams in which temperature detected values of two temperature sensors are compared with each other.
Figure 7B:
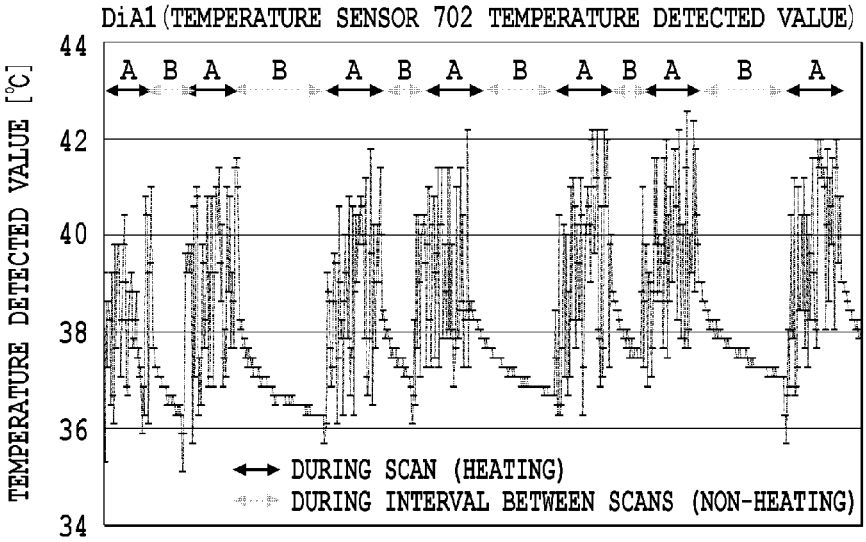
Figure 8:
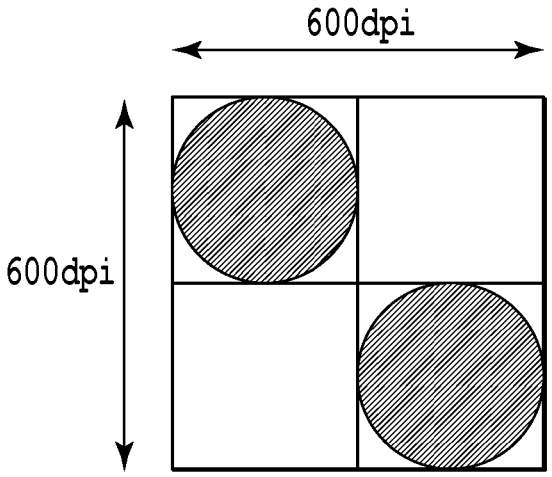
FIG. 8 is a diagram illustrating dot arrangement in the case where a print duty is 50%.

FIGS. 7A and 7B are diagrams that compare a temperature detected value of the temperature sensor 701 with a temperature detected value of the temperature sensor 702. In each of the diagrams, temperature detected values obtained when the carriage M4001 is scanned seven times with the central two arrays of the four nozzle arrays performing ejection at a print duty of 50% as illustrated in FIG. 8 are shown. The horizontal and vertical axes represent time and a temperature detected value at each time, respectively, and a sampling period is set to 10 ms. Also, in both of the diagrams, arrow A represents a printing period during which a print scan is performed, and arrow B represents a non-printing period during which no print scan is performed.

In any of the diagrams, it turns out that during the printing period, the detected temperature rises, and during the non-printing period, the temperature falls. Note that the temperature detected value of the temperature sensor 702 (FIG. 7B) has larger noise than that of the temperature detected value of the temperature sensor 701 (FIG. 7A) correspondingly to the longer wired length of the wiring line, and during the printing period, a degree of noise superimposition is larger than that during the non-printing period. In this example, a temperature detection error of the temperature sensor 702 during the printing period is approximately 1.5° C. on average, and up to approximately 2.5° C., and in order to utilize the temperature detected value of the temperature sensor 702 for ejection amount control, a large-scale correction process is required.

If the detected temperature during the printing period does not rise so much, as disclosed in Japanese Patent Laid-Open No. 2002-264305, the detected temperature during the non-printing period (interval) can also be used; however, as in the present example, in the case where the temperature rise during the printing period is large, it is still required to obtain accurate temperature during the printing period. Note that, according to intensive examination by the present inventors, large noise as in FIG. 7B appeared in the case where a print duty was high to some extent, i.e., the number of simultaneously driven printing elements was large. Also, it was confirmed that at low print duty where the number of simultaneously driven electrothermal transducing elements within a printing element substrate was 32 or less as in many images, such large noise did not appear. In the case where the number of simultaneously driven elements is 32 or less, a maximum value of a variation in current per unit time flowing through a driving voltage wiring part of the printing element substrate is approximately 1.6 A, which keeps the error due to the electromagnetic inductive noise on the temperature sensor output value equal to or less than ±1.0° C., and therefore does not influence an image. For reference, in the case where the number of simultaneously driven elements is 256, the variation in current per unit time goes up to near 10 A.

Figure 9A:
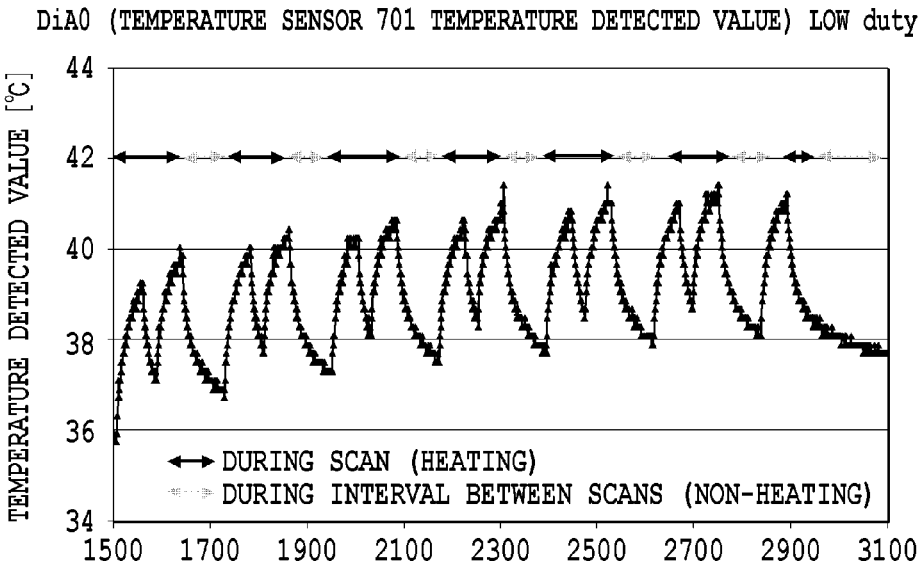
FIGS. 9A and 9B are diagrams in which temperature detected values of the two temperature sensors are compared with each other.
Figure 9B:
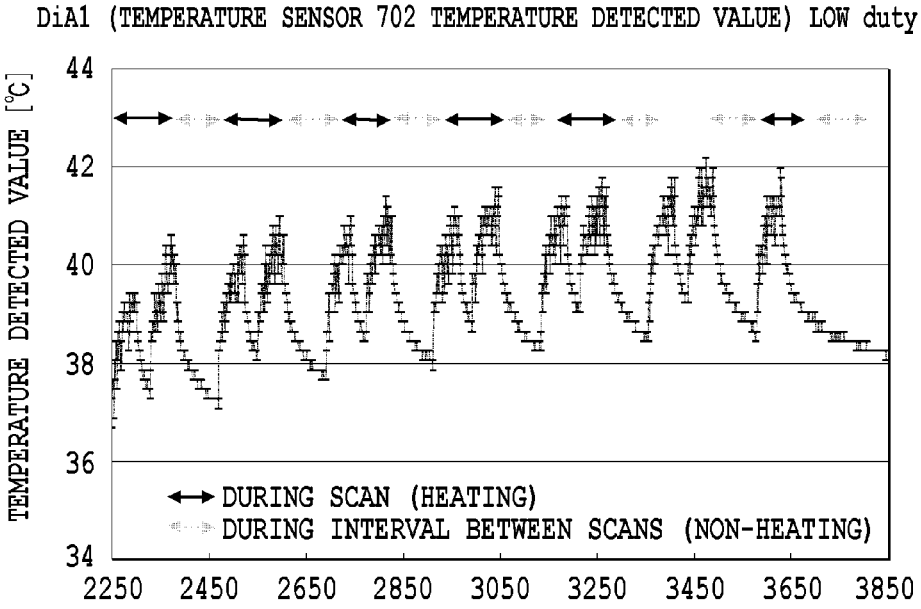

FIGS. 9A and 9B are diagrams that compare a temperature detected value of the temperature sensor 701 with a temperature detected value of the temperature sensor 702 in the case of low print duty where the number of simultaneously driven elements is 32 or less. As in the case of FIGS. 7A and 7B, noise is more superimposed on the temperature detected value of the temperature sensor 702 than the temperature detected value of the temperature sensor 701; however, a degree of the superimposition is sufficiently lower than that in the case of FIG. 7B. Also, in the case of the noise as illustrated in FIG. 9B, without performing the large-scale correction process, the temperature detected value of the temperature sensor 702 can be used for the ejection amount control.

In consideration of the above description, in the present embodiment, the number of times of driving within a predetermined period of time (hereinafter referred to as a drive frequency) is counted, and depending on the drive frequency, a temperature sensor of which a temperature detected value is switched. In the following, a temperature detecting method for the printing element substrate in the present embodiment is specifically described.

Figure 10:
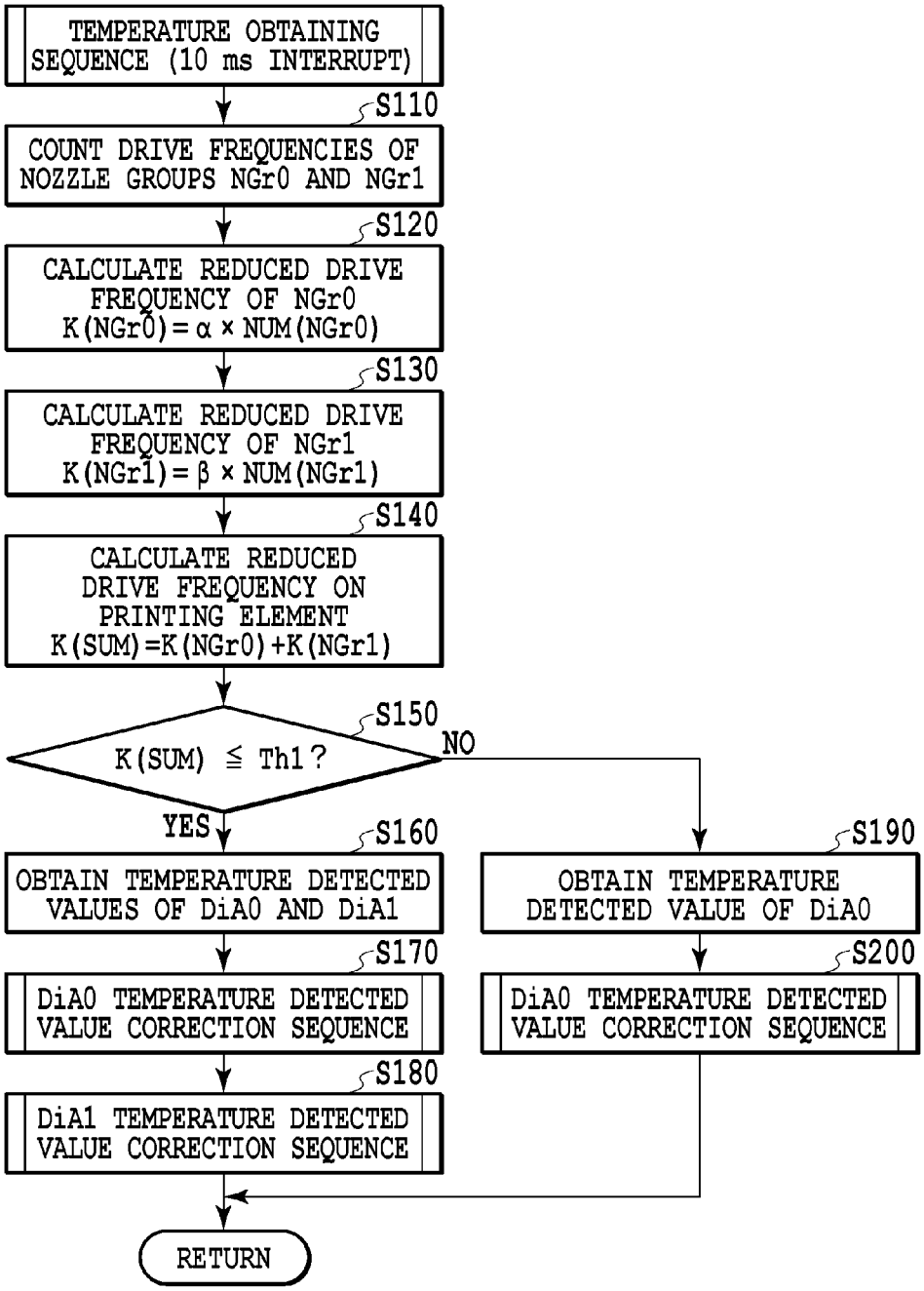
FIG. 10 is a flowchart of a temperature detecting sequence for the printing element substrate in a first embodiment.

FIG. 10 is a flowchart for explaining a temperature detecting sequence for the printing element substrate 801, which is performed by the ASIC 308 of the present embodiment. This sequence is assumed to be interruptedly processed at intervals of 10 ms during a period from time when the printing apparatus receives a print start job to time when the printing apparatus finishes the job. Note that the time interval of 10 ms can be adjusted depending on a situation.

When the sequence is started, in Step S110, the ASIC 308 first obtains a drive frequency NUM(NGr0) of a nozzle group NGr0 and a drive frequency NUM(NGr1) of a nozzle group NGr1 in 10 ms. Referring to FIG. 6 again, the nozzle group NGr0 refers to four arrays each of 512 printing elements positioned on an upstream side (−Y direction side) in a conveying direction, of 1024 nozzles (printing elements) arrayed in the Y direction. Similarly, the nozzle group NGr1 refers to four arrays each of 512 printing elements positioned on a downstream side (+Y direction side) in the conveying direction of 1024 nozzles (printing elements) arrayed in the Y direction. That is, the nozzle group NGr0 is a nozzle group near the temperature sensor 701, and the nozzle group NGr1 is a nozzle group near the temperature sensor 702.

In Step S120, the ASIC 308 makes a weighting correction on the drive frequency NUM(NGr0) to calculate a reduced drive frequency K(NGR0). Also, in Step S130, the ASIC 308 makes the weighting correction on the drive frequency NUM (NGr1) to calculate a reduced drive frequency K(NGR1). The weighting correction is one that multiplies the drive frequencies NUM(NGr0) and NUM(NGr1) by corresponding weighting coefficients $\alpha$ and $\beta$ ($<\alpha$), respectively.

In Step S140, the reduced drive frequencies K(NGr0) and K(NGr1) obtained in Steps S120 and S130 are added to each other to obtain a reduced summation drive frequency K(SUM)=K(NGr0)+K(NGr1).

Subsequently, in Step S150, the reduced summation drive frequency K(SUM) is compared with a prepared threshold value Th1. If K(SUM)≤Th1, it is determined that the drive frequency is sufficiently small, and even in the case of the temperature sensor 702 having a longer wiring length, the influence of noise on a detected value of the temperature sensor 702 is small, and the sequence proceeds to Step S160. On the other hand, if K(SUM)>Th1, it is determined that the drive frequency is large, and the influence of noise on the detected value of the temperature sensor 702 is large, and the sequence proceeds to Step S190.

In Step S160, temperature detected values of both of the temperature sensors 701 (DiA0) and 702 (DiA1) are obtained. Then, in Step S170, a DiA0 correction sequence is performed on the temperature detected value from the temperature sensor 701 (DiA0), and in Step S180, a DiA1 correction sequence is performed on the temperature detected value from the temperature sensor 702 (DiA1). After that, two temperature correction values TempC(DiA0) and TempC (DiA1) obtained in Steps S170 and S180 are used as the printing element substrate temperature for performing the ejection amount control.

On the other hand, in Step S190, a temperature detected value of only the temperature sensor 701 (DiA0) is obtained, and in Step S200, the DiA0 correction sequence is performed on the temperature detected value from the temperature sensor 701 (DiA0). After that, one temperature correction value TempC(DiA0) obtained in Step S200 is used as the printing element substrate temperature for performing the ejection amount control.

Figure 11A:
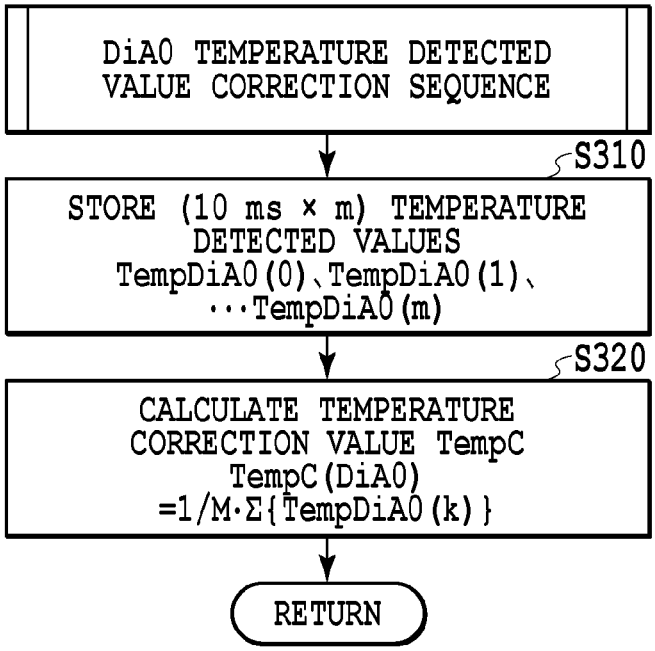
FIGS. 11A and 11B are flowcharts of detected temperature correction sequences.
Figure 11B:
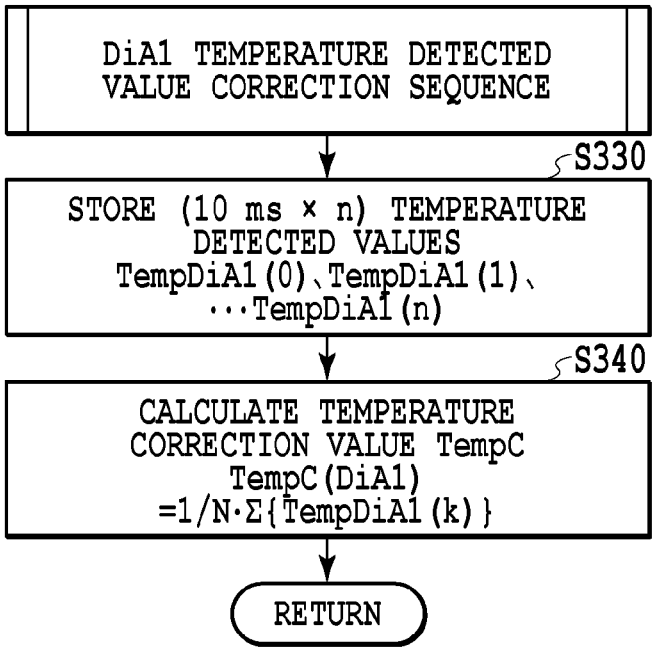

FIG. 11A is a flowchart of the DiA0 correction sequence performed in Step S170 or S200, and FIG. 11B is a flowchart of the DiA1 correction sequence performed in Step S180 on the temperature detected value of the temperature sensor 702.

In Step S310 of FIG. 11A, the ASIC 308 stores, in addition to the temperature detected value obtained in Step S160 by the temperature sensor 701, m temperature detected values obtained at the intervals of 10 ms by the temperature sensor 701 in TempDiA0(1) to TempDiA0(*m*). Then, in Step S320, a moving average process is performed on TempDiA0(1) to TempDiA0(*m*) to obtain the temperature correction value TempC(DiA0).

On the other hand, in the DiA1 correction sequence, the ASIC 308 stores, in addition to the temperature detected value obtained in Step S160 by the temperature sensor 702, n temperature detected values obtained at the intervals of 10 ms by the temperature sensor 702 in TempDiA1(1) to TempDiA1 (*n*). Then, in Step S320, the moving average process is performed on TempDiA1(1) to TempDiA1(*n*) to obtain the temperature correction value TempC(DiA1). At this time, the number of pieces of data n used for the temperature correction value of the temperature sensor 702 (DiA1) is made larger than the number of pieces of data m used for the temperature correction value of the temperature sensor 701 (DiA0). This is because by increasing an area in size where the moving average is performed on the temperature detected values from the temperature sensor 702, on which larger noise is likely to be superimposed, a smoothing effect in the temperature calculation is enhanced.

The ASIC 308 of the present embodiment performs the subsequent ejection amount control on the basis of both of the temperature correction values TempC(DiA0) and TempC (DiA1) or only the temperature correction value TempC (DiA0) obtained in the above steps. For example, in the case where the temperature correction values TempC(DiA0) and TempC(DiA1) are obtained in Steps S170 and S180, on the basis of the two values, the ASIC 308 indicates a driving pulse for the ejection amount control to the head driving signal control part 310. On the other hand, in the case where the temperature correction value TempC(DiA0) is obtained in Step S200, on the basis of the value, the ASIC 308 indicates a driving pulse for the ejection amount control to the head driving signal control part 310.

As described above, according to the present embodiment, in the case where a drive frequency within a predetermined period of time is small (a print duty is low), i.e., the number of simultaneously driven printing elements can be considered as being small, it is determined that even in the case of the temperature sensor 702 having a relatively long wiring length, the influence of noise on a detected value of the sensor 702 is small. Then, the detected value is used for detecting temperature of the printing element substrate. On the other hand, in the case where a drive frequency within the predetermined period of time is large (a print duty is high), i.e., the number of simultaneously driven printing elements can be considered as being large, it is determined that the influence of noise on a detected value of the temperature sensor 702 having a relatively long wiring length is large, and the value is not used for detecting the temperature of the printing element substrate.

According to the present embodiment, only information from a temperature sensor on which the influence of noise is determined to be within an allowable range is used to calculate overall temperature of the printing element substrate. By doing so, even if not in the disabled (OFF) state, the overall temperature of the printing element substrate can be highly accurately obtained with the influence of noise being prevented as much as possible. Also, in the case where a print duty of printing elements is high, as compared with the case of a low print duty, temperature of a surface of the printing element substrate is likely to be uniform, and therefore it can be said that reliability of a detected value of one of the temperature sensors is high.

(Second Embodiment)

The present embodiment is also assumed to use the inkjet printing apparatus and print head illustrated in FIGS. 1 to 6. Note that, in the first embodiment, of the plurality of temperature sensors, a temperature sensor used to obtain temperature of the printing element substrate is switched depending on a print duty; however, in the present embodiment, it is assumed that a temperature sensor is switched depending on an operation state of the printing apparatus.

Figure 12:
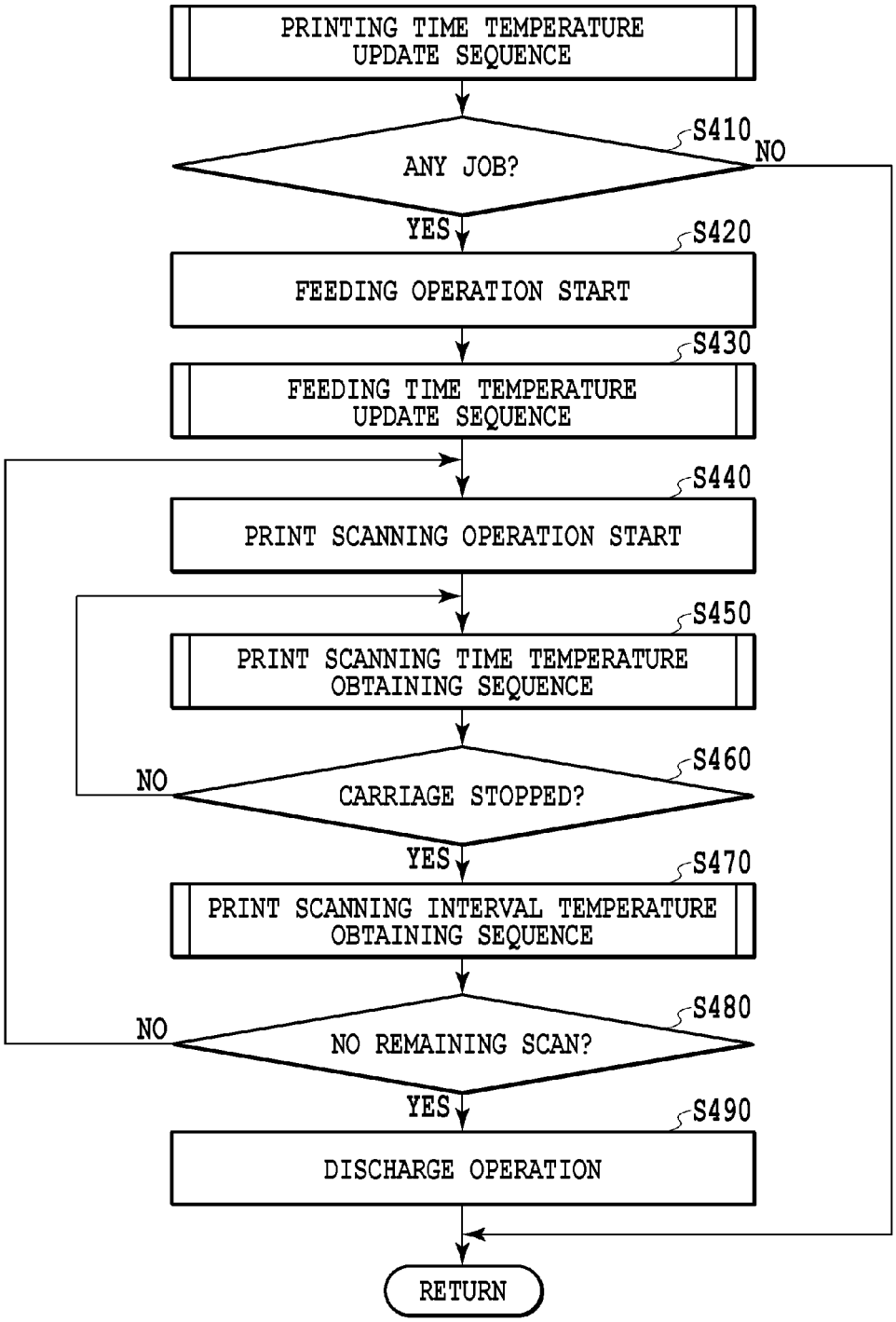
FIG. 12 is a flowchart of a temperature detecting sequence for a printing element substrate in a second embodiment.

FIG. 12 is a flowchart for explaining a temperature detecting sequence for the printing element substrate 801, which is performed by the ASIC 308 of the present embodiment. This sequence is assumed to be interruptedly processed at constant intervals of 10 ms when the printing apparatus is powered on.

When the sequence is started, the ASIC 308 first determines in Step S410 whether or not the printing apparatus has received a print job. If the printing apparatus has not received the print job, the sequence is directly finished. If the printing apparatus has received the print job, the ASIC 308 starts a feeding operation in Step S420, and in Step S430, performs a feeding time temperature update sequence. A driving pulse used during first 10 ms of a first print scan is set on the basis of temperature obtained by the feeding time temperature update sequence.

Then, the sequence proceeds to Step 440, where the ASIC 308 starts a print scan according to the received job, and in Step S450, performs a print scanning time temperature obtaining sequence. During the print scan, a driving pulse used during next 10 ms is set on the basis of temperature obtained by the last print scanning time temperature obtaining sequence.

In Step S460, it is determined whether or not the one print scan has been finished and the carriage M4001 has been stopped. If the carriage M4001 has not been stopped yet, the sequence returns to Step S450, where in order to set the driving pulse used during next 10 ms, the print scanning time temperature obtaining sequence is again performed.

In Step S460, if it is determined that the carriage M4001 has been stopped, the sequence proceeds to Step S470, where a print scanning interval temperature obtaining sequence is performed. A driving pulse used during first 10 ms in the next print scan is set on the basis of temperature obtained by the print scanning interval temperature obtaining sequence.

In Step S480, it is determined whether or not all print scans have been finished. If it is determined that some print scans remain, the sequence returns to Step S440, where the next print scan is performed. On the other hand, in Step S480, if it is determined that all print scans have been finished, a print medium is discharged in Step S490 to finish the series of processing steps.

Figures 13A, 13B, 13C:
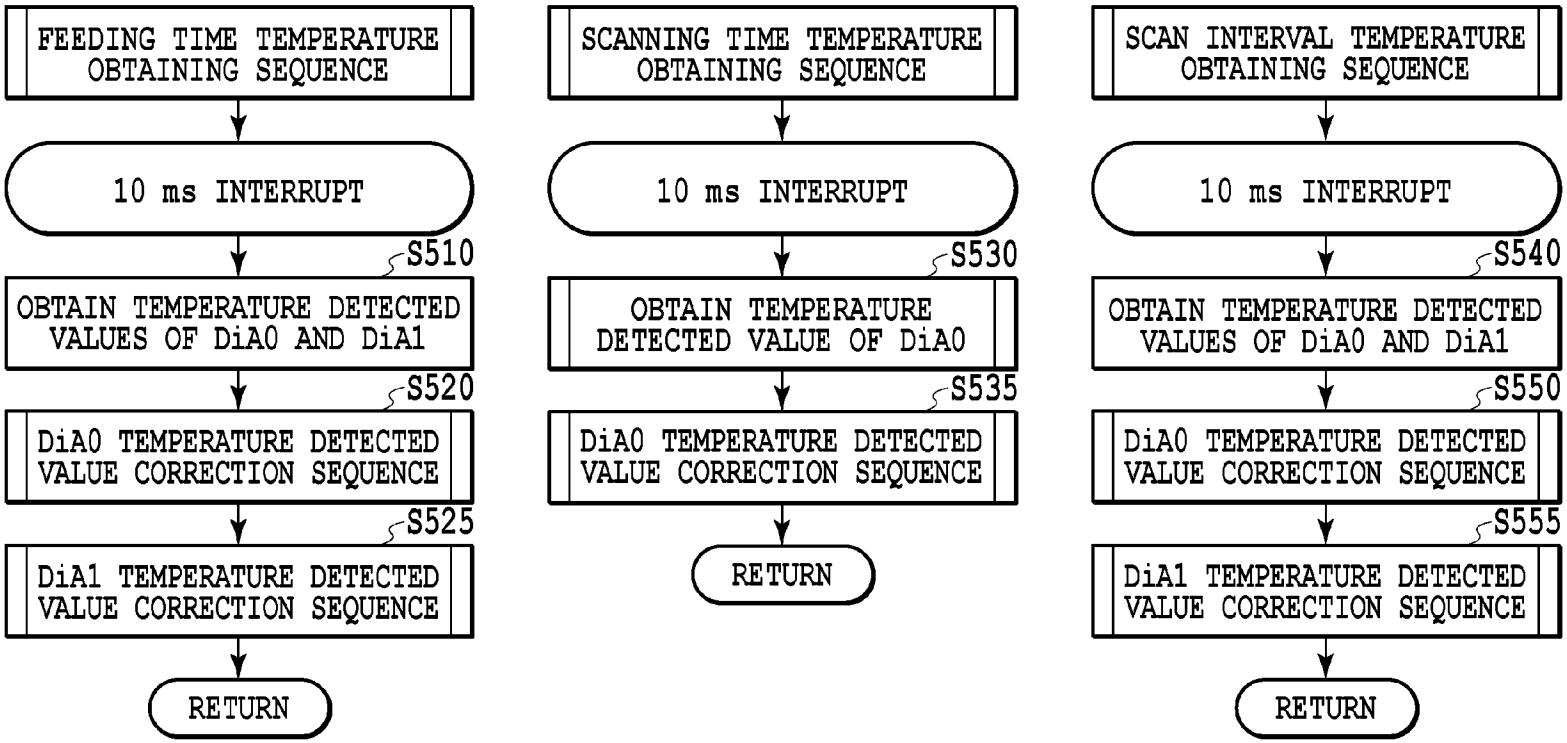
FIGS. 13A to 13C are flowcharts respectively illustrating a feeding time temperature update sequence, print scanning time temperature obtaining sequence, and print scanning interval temperature obtaining sequence.

FIGS. 13A to 13C are flowcharts respectively illustrating the feeding time temperature update sequence, print scanning time temperature obtaining sequence, and print scanning interval temperature obtaining sequence in the present embodiment.

In FIG. 13A, when the feeding time temperature update sequence is started, the ASIC 308 performs the interrupt processing every 10 ms, and in Step S501, obtains temperature detected values of the temperature sensors 701 (DiA0) and 702 (DiA1). Then, in Step S520, the DiA0 temperature detection correction sequence illustrated in FIG. 11A is performed, and in Step S525, the DiA1 temperature detection correction sequence illustrated in FIG. 11B is performed. At the time of paper feeding, no printing element is driven, so that it is determined that the influence of noise on both of the temperature sensors 701 and 702 is small, and therefore the temperature detected values of the both temperature sensors are used as described.

In FIG. 13B, when the print scanning time temperature obtaining sequence is started, the ASIC 308 performs the interrupt processing every 10 ms, and in Step S530, obtains a temperature detected value of the temperature sensor 701 (DiA0). Then, in Step S535, the DiA0 temperature detection correction sequence illustrated in FIG. 11A is performed. During a print scan, it is determined that noise of the temperature sensor 702 (DiA1) is large as compared with that of the temperature sensor 701 (DiA0), and the influence of the noise is out of the allowable range, and therefore the temperature detected value of only the temperature sensor 701 (DiA0) is used.

In FIG. 13C, when the print scanning interval temperature obtaining sequence is started, the ASIC 208 performs the interrupt processing every 10 ms, and in Step S540, obtains temperature detected values of the temperature sensors 701 (DiA0) and 702 (DiA1). Then, in Step S550, the DiA0 temperature detection correction sequence illustrated in FIG. 11A is performed, and in Step S555, the DiA1 temperature detection correction sequence illustrated in FIG. 11B is performed. During an interval between print scans, as during the time of paper feeding, no printing element is driven, so that it is determined that the influence of noise on both of the temperature sensors 701 and 702 is small, and therefore the temperature detected values of the both temperature sensors are used.

Figure 14:
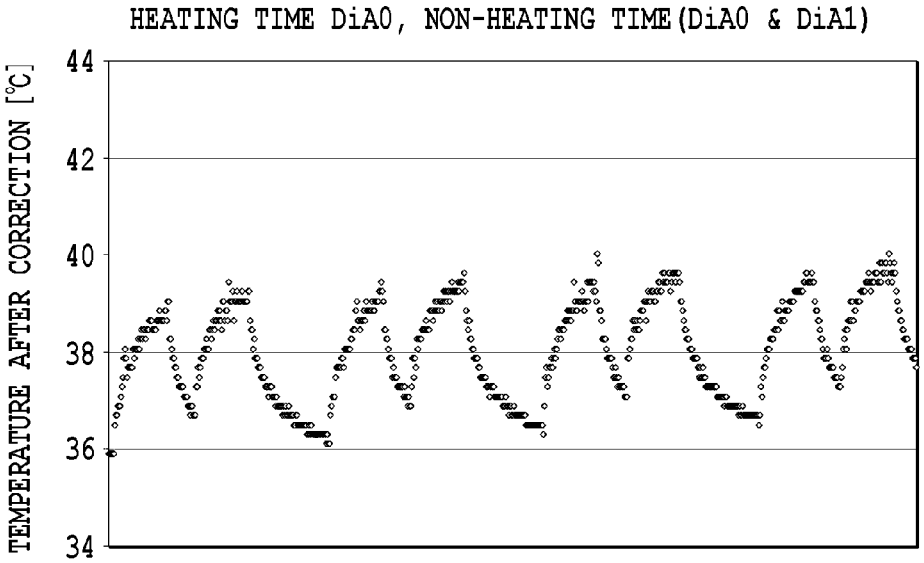
FIG. 14 is a diagram illustrates a situation of a change in temperature detected value.

FIG. 14 is a diagram illustrates a situation of a change in temperature detected value observed when temperature of the printing element substrate is detected according to the flowchart illustrated in FIG. 12. During a print scan causing large noise, temperature detected values only from the temperature sensor 701 (DiA0) are plotted, and during a paper feeding or an interval between print scans causing small noise, average values of temperature detected values between the temperature sensors 701 (DiA0) and 702 (DiA1) are plotted. It turns out that temperature detected values having small noise are steadily obtained.

As described above, according to the present embodiment, only in an non-operating state where the influence of noise is small, as during the time of non-printing, pieces of information of both of the temperature sensors 701 (DiA0) and 702 (DiA1) are used to calculate the overall temperature of the printing element substrate. On the other hand, at a time when the influence of noise is large, as during the time of printing, information of only the temperature sensor 701 (DiA0) having a relatively short wiring length is used to calculate the overall temperature of the printing element substrate. By doing so, the overall temperature of the printing element substrate can be highly accurately obtained with the influence of noise being prevented as much as possible.

(Third Embodiment)

The present embodiment is also assumed to use the inkjet printing apparatus and print head illustrated in FIGS. 1 to 6. Note that, in any of the above-described embodiments, described is the case of detecting temperature of one printing element substrate; however, in the present embodiment, described is the case of detecting temperatures of a plurality of parallel arrayed printing element substrates.

Figure 15A:
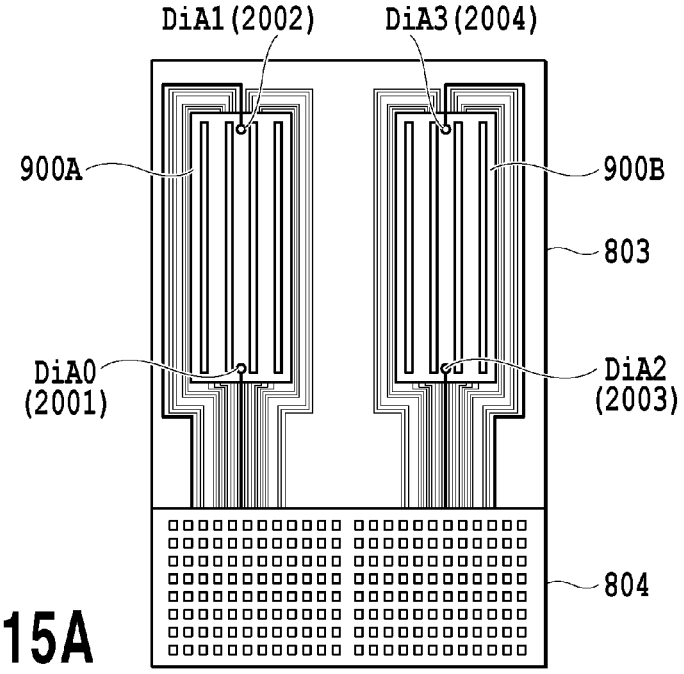
FIGS. 15A and 15B are diagrams illustrating examples of pluralities of parallel arrayed printing element substrates.
Figure 15B:
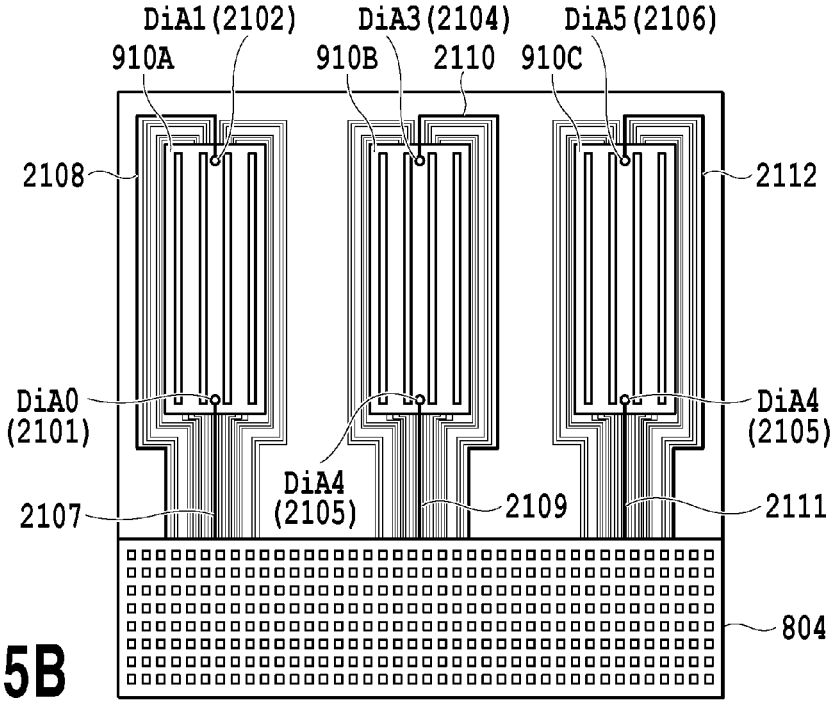

FIGS. 15A and 15B are diagrams illustrating examples of parallel arrays of pluralities of printing element substrates and wiring lines. FIG. 15A illustrates a configuration in which two printing element substrates 900A and 900B each having the same construction as that of the printing element substrate illustrated in FIG. 6 are parallel arranged. In the case of such a configuration, wiring lines provided on the flexible wiring boards from temperature sensors 2002 and 2004 on a side distant from the contact wiring board 804 are, as illustrated in the diagram, configured to be wired around in side parts on sides opposite to each other with respect to the printing element substrates. If doing so, by performing the same temperature detection as that in any of the above-described embodiments, temperatures of the respective printing element substrates can be detected with almost the same accuracy.

On the other hand, FIG. 15B illustrates a configuration in which three printing element substrates 910A, 910B, and 910C each having the same construction as that of the printing element substrate illustrated in FIG. 6 are parallel arranged. In the case of such a configuration, regarding the printing element substrates 910A and 910C on both sides, as illustrated in FIG. 15A, if wiring lines are configured to be wired around in side parts on sides opposite to each other with respect to the printing element substrates, temperatures can be detected with the same accuracy as that in any of the above-described embodiments. However, in the central printing element substrate 910B, even if a wiring line for a temperature sensor 2104 on a side distant from the contact wiring board 804 is wired around on any of left and right sides, a path of the wiring line is subjected to current interference from signal lines of any of the adjacent printing element substrates. That is, an amount of noise superimposed on the wiring line 2110 is larger than that superimposed on the wiring line 2108 or 2112. Accordingly, in the present embodiment, a temperature detecting sequence for the central printing element substrate 910B is prepared separately from that for the printing element substrates 910A and 910C on the both sides.

It is here assumed that the temperature detecting sequence for the printing element substrates 910A and 910C is the same as that illustrated in FIGS. 10, 11A, and 11B.

Figure 16:
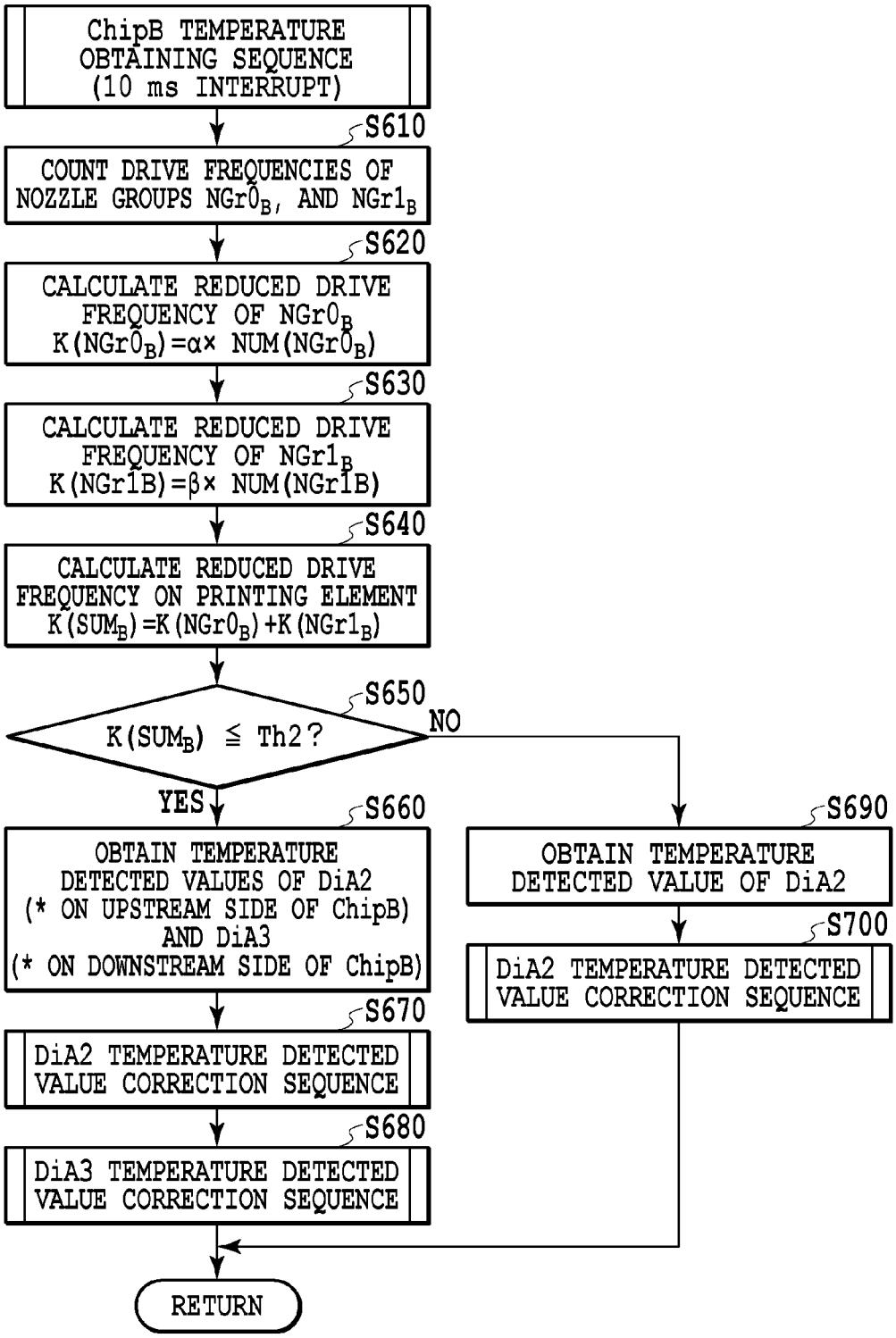
FIG. 16 is a flowchart of a temperature detecting sequence for a printing element substrate in a third embodiment.

FIG. 16 is a flowchart for explaining the temperature detecting sequence for the printing element substrate 910B, which is performed by the AISC 308 of the present embodiment. In this flowchart, points of difference from the flowchart of FIG. 10 described in the first embodiment is content of a temperature detected value correction sequence in Step S650 and Step S680. In the following, the points of difference are sequentially described.

In Step S650, a threshold value Th2 for comparing with a reduced summation drive frequency K(SUMB) of the printing element substrate 910B is a smaller value than the threshold value Th1 described in FIG. 10. That is, a condition for enabling temperature detected values of both of the two temperature sensors 2103 (DiA2) and 2104 (DiA3) to be used is stricter than a condition for the other printing element substrates. This is because the influence of noise on the temperature sensor 2104 (DiA3) arranged on the printing element substrate 910B is expected to be larger than the influence of noise on the temperature sensors 2102 (DiA1) and 2106 (DiA5) on the other two substrates.

Figure 17A:
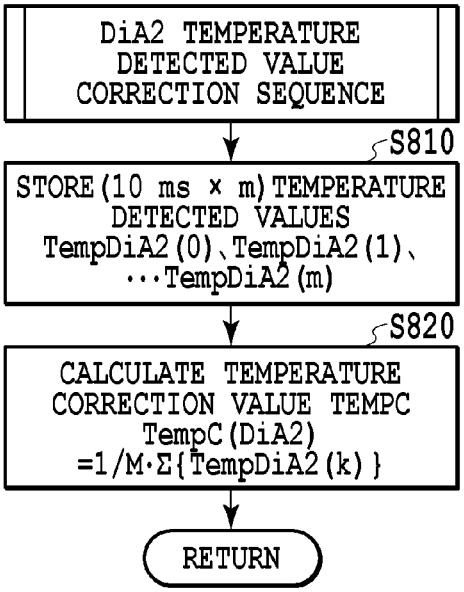
FIGS. 17A and 17B are flowcharts of detected temperature correction sequences.
Figure 17B:
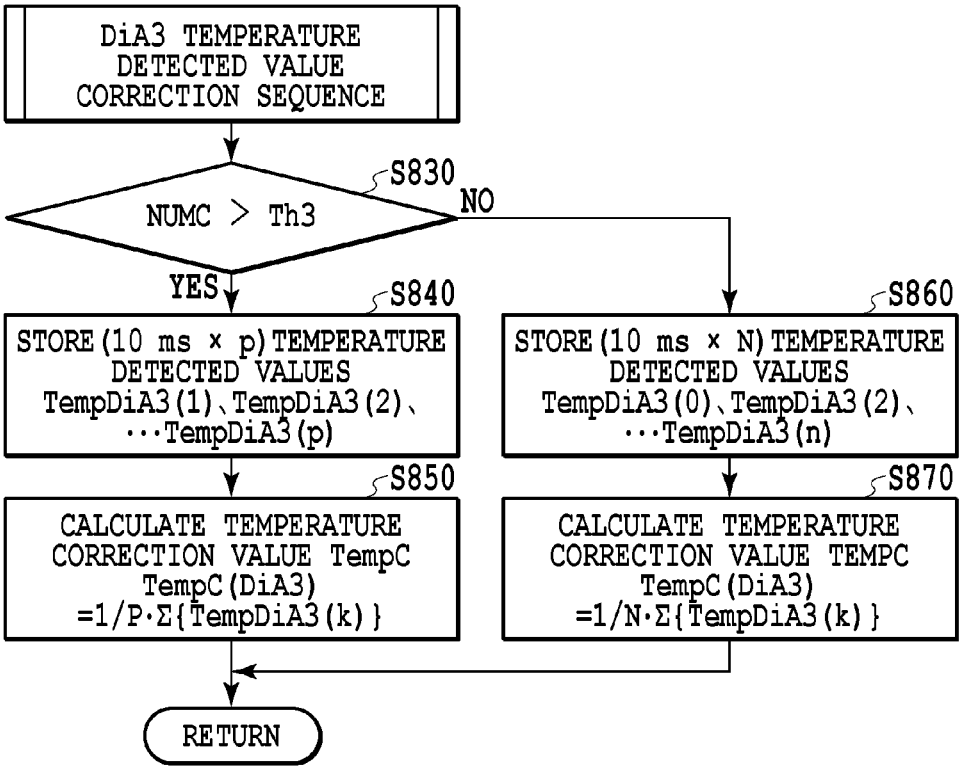

On the other hand, FIG. 17A is a flowchart of a DiA2 correction sequence performed in Step S670 or S700. Also, FIG. 17B is a flowchart of a DiA3 correction sequence performed on a temperature detected value of the temperature sensor 2104 (DiA3) in Step S680. For FIG. 17A, i.e., for the temperature sensor 2103 (DiA2) having a shorter wiring length, the same manner as that for the temperature sensor 701 (DiA0) in the first embodiment illustrated FIG. 11A holds.

In FIG. 17B, when the sequence is started, in Step S830, the ASIC 308 first obtains a drive frequency NUMc of the printing element substrate 910C adjacent to the wiring line for the temperature sensor 2104, and compares it with a threshold value Th3. If NUMc>Th3, it is determined that the influence of noise from the adjacent printing element substrate 910C is relatively large, and the sequence proceeds to Step S840. On the other hand, if NUMc≤Th3, it is determined that the influence of the noise from the adjacent printing element substrate 910C is relatively small, and the sequence proceeds to Step S860.

In Step S840, the ASIC 308 stores, in addition to the temperature detected value of the temperature sensor 2104 obtained in Step S660, p temperature detected values obtained at the intervals of 10 ms by the temperature sensor 2104 in TempDiA3(1) to TempDiA3(*p*). On the other hand, in Step S860, the ASIC 308 stores, in addition to the temperature detected value of the temperature sensor 2104 obtained in Step S660, n temperature detected values obtained at the intervals of 10 ms by the temperature sensor 2104 in TempDiA3(1) to TempDiA3(*n*). Note that the number p of the detected values stored in Step S840 is larger than the number n of the detected values stored in Step S860. Further, in Steps S850 and 870, moving averages of the detected values corresponding to the stored numbers are respectively obtained to obtain a temperature correction value TempC(DiA3). Up to here, this sequence is finished.

According to the above sequence, if NUMc>Th3, i.e., if the drive frequency of the adjacent printing element substrate is more than the threshold value, it is determined that the noise from adjacent wiring lines is large, and therefore the number p of pieces of data used for the temperature correction value is set relatively large to enhance a smoothing effect. On the other hand, if NUMc≤Th3, i.e., if the drive frequency of the adjacent printing element substrate is equal to or less than the threshold value, it is determined that the noise from the adjacent wiring lines is small, and therefore the number n of pieces of data used for the temperature correction value is set relatively small to shorten a time required for the correction process.

According to the present embodiment described above, in the print head in which the plurality of printing elements are arrayed, even in the case where electrical wiring interference occurs between printing elements, overall temperature of a printing element substrate can be highly accurately obtained with the influence of noise being prevented as much as possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-002309 filed on Jan. 10, 2012, and 2012-242729 filed on Nov. 2, 2012, which are hereby incorporated by reference herein in their entirety.

What is claimed is:

1. A printing apparatus comprising:

a print head comprising (a) a printing element substrate having a printing element array in which a plurality of printing elements for generating heat energy are arranged in a predetermined direction, a first temperature sensor for detecting a temperature of printing elements positioned at a first position of the printing element array in the predetermined direction, and a second temperature sensor for detecting a temperature of printing elements positioned at a second position of the printing element array which is different from the first position in the predetermined direction, and (b) an electric line member which is electrically contacted with the printing element substrate, and is provided with a driving line for applying energy to drive the plurality of printing elements, a first output line for transmitting a signal from the first temperature sensor to the printing apparatus, and a second output line, being longer than the first output line, for transmitting a signal from the second temperature sensor to the printing apparatus;

a first obtaining unit for obtaining information regarding a temperature of the printing element substrate by using at least one of the signals transmitted from the first temperature sensor and the second temperature sensor;

a second obtaining unit for obtaining a value regarding an amount of ink ejection per unit time from the print head; and an ejection controlling unit for controlling ejection of ink by applying a driving pulse to the plurality of printing elements based on the temperature indicated by the information obtained by the first obtaining unit, wherein (i) in a case that the value obtained by the second obtaining unit is less than or equal to a predetermined threshold value, the first obtaining unit obtains the information regarding the temperature of the printing element substrate based on both of the signal transmitted by the first output line from the first temperature sensor and the signal transmitted by the second output line from the second temperature sensor, and (ii) in a case that the value obtained by the second obtaining unit is larger than the predetermined threshold value, the first obtaining unit obtains the information regarding the temperature of the printing element substrate based on the signal transmitted by the first output line from the first temperature sensor, without using the signal transmitted by the second output line from the second temperature sensor.

2. The printing apparatus according to claim 1, wherein the driving line, the first output line and the second output line are arranged in parallel in a region.

3. The printing apparatus according to claim 1, wherein the first temperature sensor and the second temperature are diode sensors.

4. The printing apparatus according to claim 1 further comprising a determining unit which determines a driving pulse to apply to the plurality of printing elements on the basis of the temperature of the printing substrate indicated by the information obtained by the first obtaining unit, wherein the ejection controlling unit controls ejection of ink by applying the driving pulse determined by the determining unit.

5. The printing apparatus according to claim 1, wherein signals transmitted through the first output line and the second output line are analog signals.

6. The printing apparatus according to claim 1, wherein a plurality of the printing element substrates are provided and the electric line contacts the plurality of the printing element substrates.

7. The printing apparatus according to claim 1, wherein the print head further comprises a connecting substrate for connecting the print head to the printing apparatus, and wherein each of the first and second output lines connects the connecting substrate and each of the first and second temperature sensors. first obtaining unit performs a moving average process on signals from the first temperature sensor and the second temperature sensor to obtain the detected temperatures of each of the first and second temperature sensors.

8. The printing apparatus according to claim 1, wherein the first obtaining unit performs a moving average process on signals from the first temperature sensor and the second temperature sensor to obtain the detected temperatures of each of the first and second temperature sensors.

9. The printing apparatus according to claim 8, wherein a number of items of data from the first temperature sensor to be used for the moving average process is less than that from the second temperature sensor to be used for the moving average process.

10. The printing apparatus according to claim 1, wherein the first temperature sensor is positioned near one end side of the printing element array in the predetermined direction, and the second temperature sensor is positioned near the other end side of the printing element array in the predetermined direction.

11. The printing apparatus according to claim 10, wherein the plurality of printing elements in the printing element array are divided into a first printing element group comprised of a predetermined number of printing elements including printing elements positioned at the one end side of the printing element array in the predetermined direction, and a second printing element group comprised of a predetermined number of printing elements including printing elements positioned at the other side of the printing element array in the predetermined direction, and wherein the second obtaining unit obtains the value by adding a first value and a second value, the first value being obtained by multiplying a value regarding an amount of ink ejection from the first printing element group by a first coefficient, and the second value being obtained by multiplying a value regarding an amount of ink ejection from the second printing element group by a second coefficient.

12. The printing apparatus according to claim 11, wherein the second coefficient is larger than the first coefficient.

13. The printing apparatus according to claim 11, wherein the value regarding the amount of ink ejection from the first printing element group is a print duty of the first printing element group, and the value regarding the amount of ink ejection from the second printing element group is a print duty of the second printing element group.

14. The printing apparatus according to claim 11, wherein the value regarding the amount of ink ejection from the first printing element group is a number of simultaneously driven printing elements of the first printing element group, and the value regarding the amount of ink ejection from the second printing element group is a number of simultaneously driven printing elements of the second printing element group.

15. A control method for a printing apparatus, the apparatus including:

a print head comprising (a) a printing element substrate having a printing element array in which a plurality of printing elements for generating heat energy are arranged in a predetermined direction, a first temperature sensor for detecting a temperature of printing elements positioned at a first position of the printing element array in the predetermined direction, and a second temperature sensor for detecting a temperature of printing elements positioned at a second position which is different from the first position of the printing element array in the predetermined direction, and (b) an electric line member which is electrically contacted with the printing element substrate, and is provided with a driving line for applying energy to drive the plurality of printing elements, a first output line for transmitting signal from the first temperature sensor to the printing apparatus, and a second output line, being longer than the first output line, for transmitting a signal from the second temperature sensor to the printing apparatus, said control method comprising steps of:

obtaining, in a first obtaining step, information regarding a temperature of the printing element substrate from at least one of the first temperature sensor and the second temperature sensor;

obtaining, in a second obtaining step, a value regarding an amount of ink ejection per unit time from the print head; and controlling ejection of ink by applying a driving pulse to the plurality of printing elements based on the temperature indicated by the information obtained in the first obtaining step, wherein (i) in a case that the value obtained in the second obtaining step is less than or equal to a predetermined threshold value, the first obtaining step obtains the information regarding the temperature of the printing element substrate based on both of the signal transmitted by the first output line from the first temperature sensor and the signal transmitted by the second output line from the second temperature sensor, and (ii) in a case that the value obtained in the second obtaining step is larger than the predetermined threshold value, the first obtaining step obtains the information regarding the temperature of the printing element substrate based on the signal transmitted by the first output line from the first temperature sensor, without using the signal transmitted by the second output line from the second temperature sensor.

* * * * *